US005289865A

United States Patent [19]

Sun

[11] Patent Number: 5,289,865

[45] Date of Patent: * Mar. 1, 1994

[54] ONE-BODY PRECISION CAST METAL WOOD

[76] Inventor: Donald J. C. Sun, 4521 Ocean Valley La., San Diego, Calif. 92130

[ * ] Notice: The portion of the term of this patent subsequent to Jun. 15, 2010 has been disclaimed.

[21] Appl. No.: 62,791

[22] Filed: May 17, 1993

Related U.S. Application Data

[63] Continuation of Ser. No. 844,757, Mar. 2, 1992, Pat. No. 5,219,408.

[51] Int. Cl.[5] ..... B22C 9/10

[52] U.S. Cl. ..... 164/76.1; 164/132; 164/365

[58] Field of Search ..... 164/369, 368, 366, 365, 164/345, 346, 132, 76.1; 273/171

[56] References Cited

U.S. PATENT DOCUMENTS

| | | | |
|---|---|---|---|
| 4,472,092 | 9/1984 | Schmidt . | |
| 4,553,755 | 11/1985 | Yamada . | |
| 4,651,799 | 3/1987 | Chandley . | |
| 4,691,759 | 9/1987 | Hayakawa et al. . | |
| 4,867,458 | 9/1989 | Sumikawa et al. . | |
| 4,869,507 | 9/1989 | Sahm . | |
| 4,951,731 | 8/1990 | Downing . | |
| 5,033,530 | 7/1991 | Egoshi et al. . | |
| 5,219,408 | 6/1993 | Sun | 164/76.1 |

*Primary Examiner*—Paula A. Bradley
*Assistant Examiner*—Erik R. Puknys
*Attorney, Agent, or Firm*—William W. Haefliger

[57] ABSTRACT

A golf club metal wood head comprising a shell having a ball striking front face, a top wall, a bottom wall, and rear wall, and toe and heel walls, the combination comprising multiple ports in the bottom wall, the ports opening to the bottom wall exterior, and multiple inserts of different weight received into the ports from the exterior and connected to the bottom wall, the inserts having weights selected for golf club balance and swing adjustment.

7 Claims, 3 Drawing Sheets

FIG. 1.
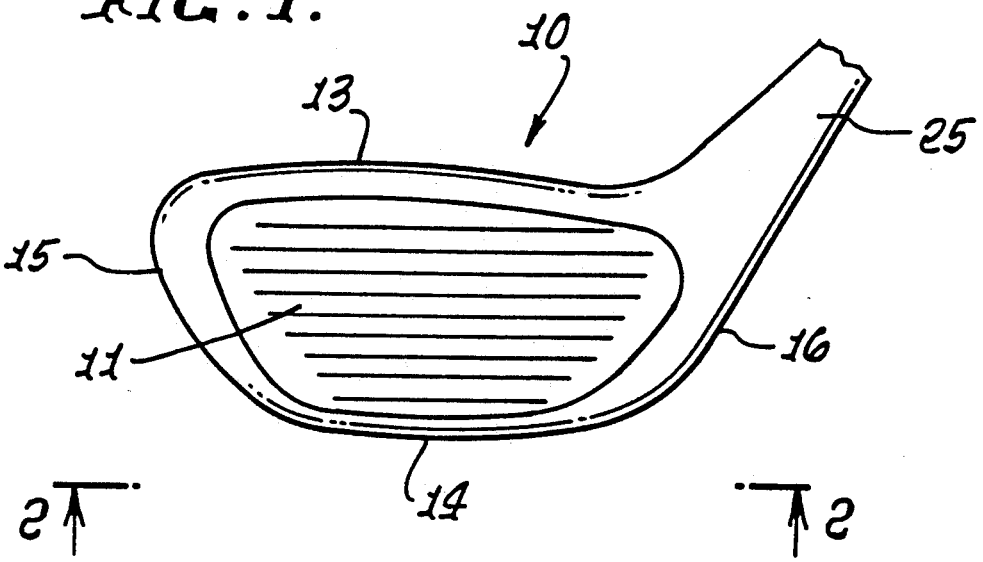
FIG. 2.
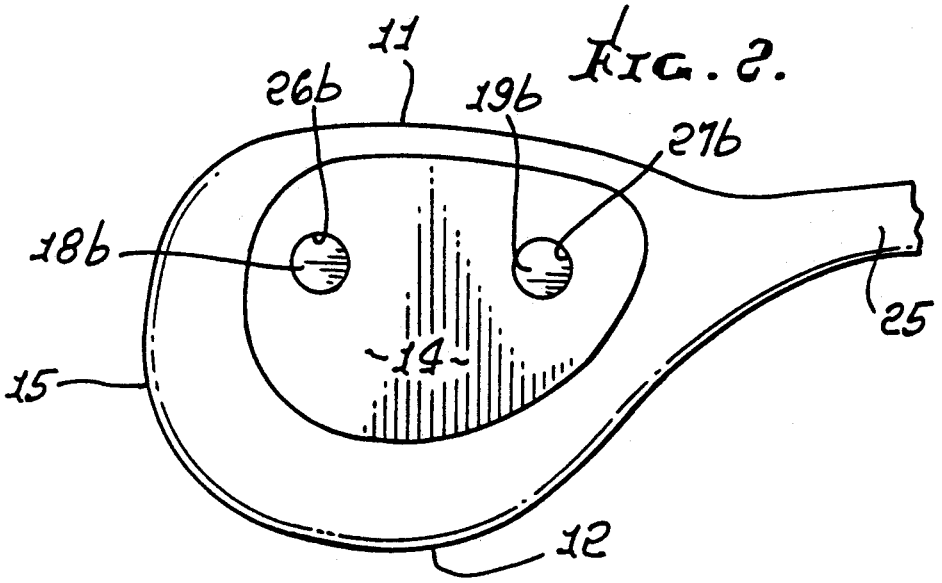
FIG. 2a.
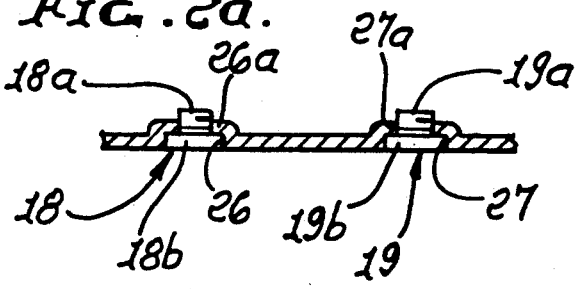
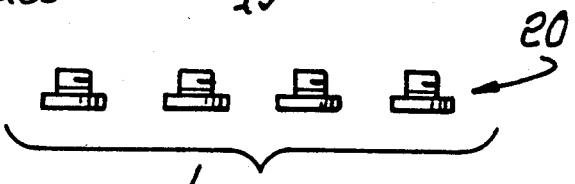
FIG. 2b.

ONE-BODY PRECISION CAST METAL WOOD

This is a continuation of application Ser. No. 07/844,757, filed Mar. 2, 1992, now U.S. Pat. No. 5,219,408.

BACKGROUND OF THE INVENTION

This invention relates generally to the making of golf club heads; and more particularly to making heads that consist of a lightweight metal shell surrounding a relatively heavy core.

Effective die design and a well-defined process capability will combine to produce quality die castings. Proper attention to die casting process control will result in consistently high quality irons. But one-body die cast metal woods are not successfully manufactured yet, since metal woods require a large interior hollow.

It is found that a sand core cannot maintain its volume and shape under high temperature and pressure during molten metal die casting. If a sand core is made to maintain its volume and shape during die casting, it can not be removed or cleaned up from the inside of a one-body cast metal wood. The difficulty of one-body die casting of metal woods consists in how to make an effective core which is tough enough against high pressure and temperature in die casting and is yet also easily removed or cleaned up in post casting operations.

SUMMARY OF THE INVENTION

It is a major object of the invention to provide a solution to the above problems and difficulties.

In accordance with the invention, the object is to form a golf club head comprising a metal shell having a ball striking face, a top wall, a bottom wall, a rear wall, and toe and heel walls, the method including the steps a) forming a head core consisting of particles of sand or the like in a binder, b) and casting molten lightweight metal about that core to form the shell walls.

As will be seen, the method typically includes forming multiple ports in the bottom wall, and connecting metal inserts into such ports. Preliminarily formed metal inserts may then be connected into such multiple ports, the inserts selected for size and weight to adjust club head balance and swinging, as by proper connection into the ports. Such ports may also be used for cleaning out the core and replacing it, if desired, with an all plastic core; or the core may be left in position in the shell (as cast), for proper weight of the head.

It is another object to employ a core coating that provides an impermeable barrier between the core and surrounding hot molten metal, during casting, to enhance the control of metal shell thickness. That coating is selected to resist decomposition at temperatures up to 1,000° C. The shell metal may itself consist of aluminum alloy.

A further object is to use a resin binder for the sand particles in the core, such binder preferably consisting of a mixture of phenolic resin and isobutyro-nitrile acid, said resin curing at high temperature.

Yet another object is to provide a golf club head as referred to, there being multiple ports in a shell bottom wall, the ports opening to the bottom wall exterior, and with multiple inserts of different weight received into the ports from the exterior and connected to the bottom wall, the inserts having weights selected for golf club balance and swing adjustment.

These and other objects and advantages of the invention, as well as the details of an illustrative embodiment, will be more fully understood from the following specification and drawings, in which:

DRAWING DESCRIPTION

FIG. 1 is a side elevational view of a one-body cast metal wood;

FIG. 2 is a bottom view of the FIG. 1 wood, taken on lines 2—2 of FIG. 1; FIG. 2*a* is a fragmentary section showing insert reception in bottom wall ports; and FIG. 2*b* shows a group of inserts;

DETAILED DESCRIPTION

Figure 3:
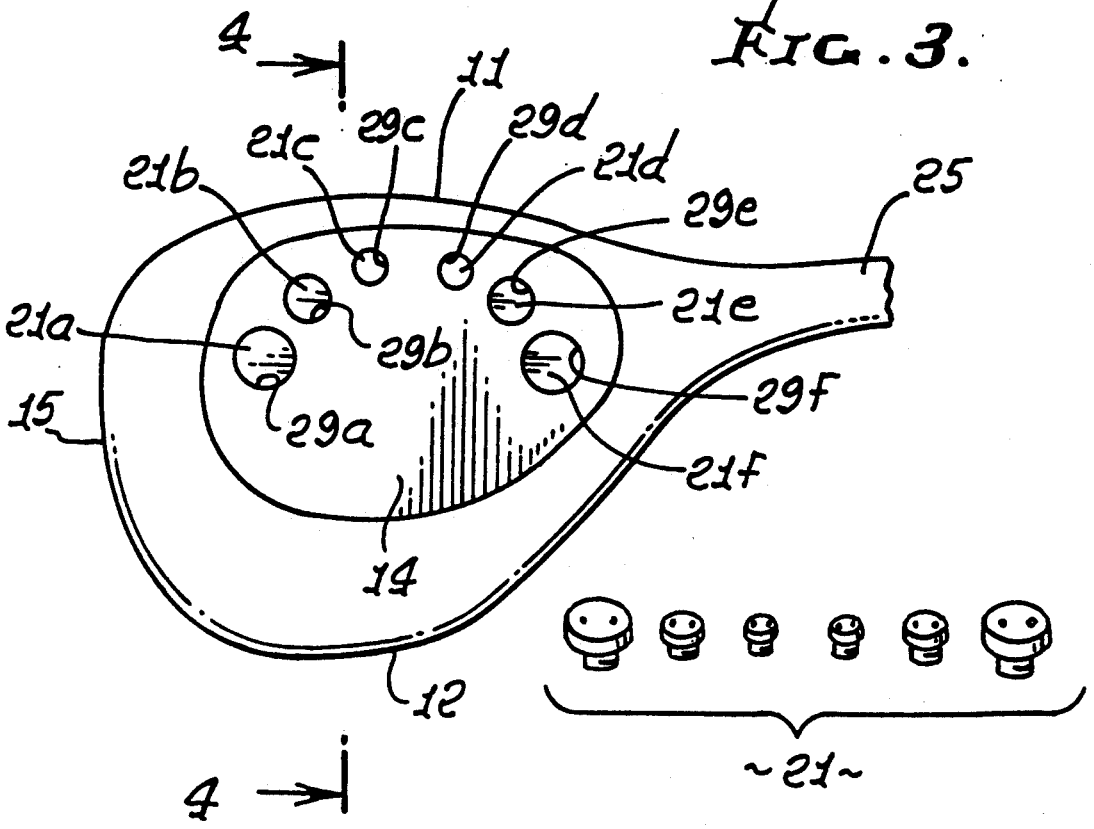
FIG. 3 is a view like FIG. 2, showing a modified head with six openings in the bottom wall, and six different inserts to be connected in those openings.

In FIGS. 1, 2 and 2*a*, the golf club head 10 has a front wall 11, a rear wall 12, a top wall 13, a bottom wall 14, toe and heel walls 15 and 16, and a hosel 25. The bottom wall has two openings 26 and 27 formed in it, for reception of two inserts 18 and 19. The inserts have threaded shafts 18*a* and 19*a* adapted to fit in threaded walls 26*a* and 27*a* of the openings. See FIG. 2*a* showing the inserts received in the threaded openings, with insert heads 18*b* and 19*b* received in counterbores 26*b* and 27*b* in the bottom wall 14. All head walls consist of lightweight metal, such as aluminum alloy, whereas the inserts consist of heavier metal such as steel.

The inserts may have different (selected) weights, so as to provide adjusted balance and swing for the club, as desired. Such weight difference may be provided by different diameter shafts and heads. For example, they may be chosen from a group 20 of such different weight inserts seen in FIG. 2*b*. Openings 26 and 27 ar spaced at different distances from the heel and toe. Furthermore, the weight containing ports provide an excellent personalization capability and also enable customized swing weight alteration anytime during the life of the club.

Figure 4:
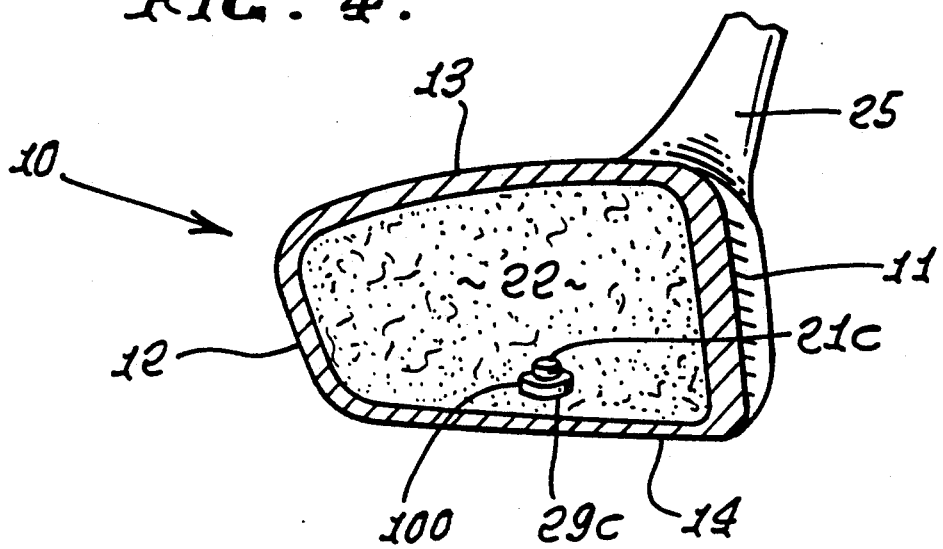
FIG. 4 is a vertical section taken through a cast metal wood, showing a bottom wall opening.

FIG. 3 is like FIG. 2, but shows six openings 29*a*–29*f* in the bottom wall 14, and arranged in an arc, with different diameter openings, and different spacings from the head and toe. The arc projects toward the front wall 11, to distribute insert wieght forwardly and rearwardly as well as laterally between heel and toe. Inserts 21*a*–21*f*, selected from a group 21, fit in the openings, and may be retained by threaded connection of insert shafts (or heads) to the head bottom wall. FIG. 4 is a section taken through the FIG. 3 head to show the position of opening 29*c*, and insert 21*c* therein, and relative to a sand core 22 in the head. Note that bottom wall 14 may have integral annular tapped projections 100 to receive the threaded insert shafts, and to seat the insert heads. See also FIG. 2*a*. The core typically consists of sand particles in a binder resin, the head metal walls consisting of aluminum alloy.

The temperature of the sand core, during die casting should be kept below the decomposition temperature of the core binder, since above that temperature the core will break down into sandy fragments.

In consideration of the thermodynamics of die casting. The heat gain must equal to heat loss in a system. The latent heat of fusion of aluminum is 389 J/g, and, $$Ma389+SaMa(Ta'-Ta)=SdMd(Td'-Td)+ScMc(Tc'-Tc).$$

M and T represent mass and temperature respectively. Meanings of all symbols in above equation are shown in the following table:

| | Temperature °C. | | Specific | Mass |
|---|---|---|---|---|
| | Before | After | Heat | gm |
| Aluminum Alloy | Ta | Ta' | Sa | Ma |
| Die | Td | Td' | Sd | Md |
| Sand Core | Tc | Tc' | Sc | Mc |

If all values are known except Tc', then Tc' can be calculated from the above equation.

Core making involves coating the aggregate (sand in this instance) particles with a binder. A typical white sand composition useful for the core is as follows.

| S102 | A1203 | MgO | CaO | percentage |
|---|---|---|---|---|
| 99.1 | 0.66 | 0.035 | 0.22 | by weight |

The pH for the sand should be between 6 and 7, for best core performance. The following binder ingredients are combined to achieve the sought results:

Phenolic resin (5110)

Isobutyro-nitrile acid (5230), 2%

Ammonia (used as a catalyst)

The weight parts of these ingredients are shown in the following table:

| Materials: | Sand (white) | Resin (5110) | Isobutyro-nitrile acid (5230) | Catalytic (ammonia) |
|---|---|---|---|---|
| Weights: | 100 g | 0.75 g | 0.75 g | 0.03 g. |

Figure 5:
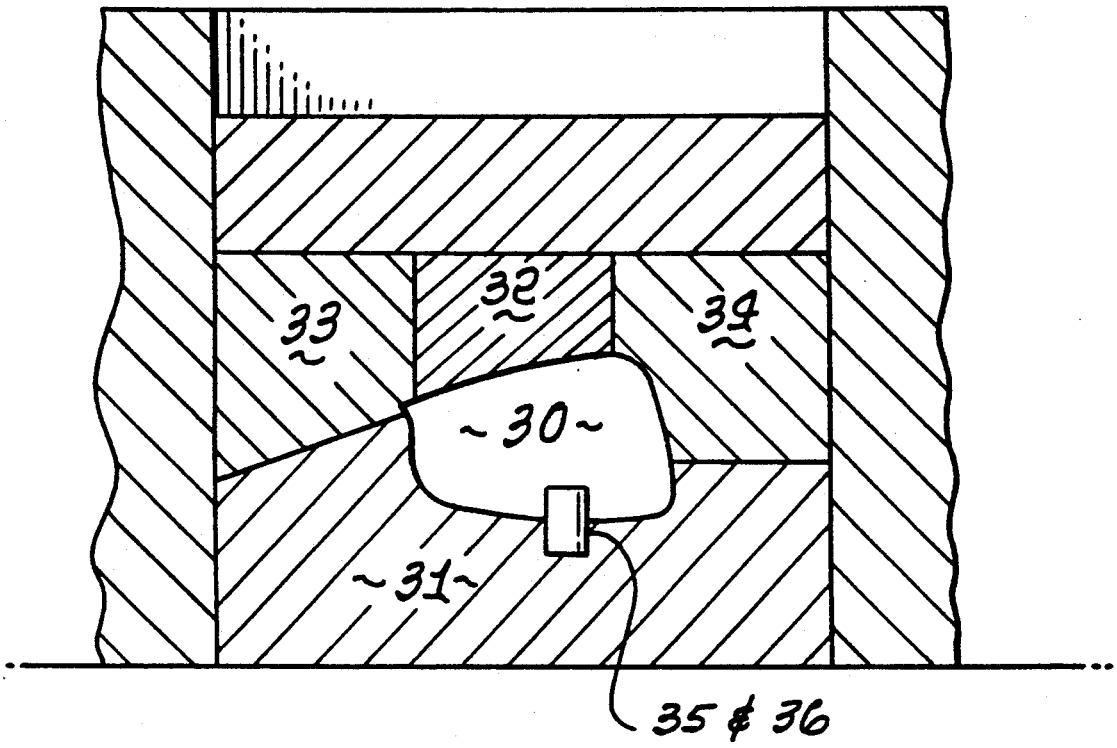
FIG. 5 is a schematic view showing mold components and a core in the mold as during casting.

These ingredients are placed in a vessel and mixing of all ingredients is continued for 30 seconds. Sufficient mixture is then placed in a core mold as seen in FIG. 5, to fill the mold hollow 30, formed by mold parts identified as follows:

fixed position mold half (lower)—31 movable upper mold part—32 movable upper mold part—33 movable mold center part—34

In the above, mold parts 32, 33 and 34 form the mold upper half. Two steel core rods 35 and 36 are also positioned as shown, to form two openings in the core, to receive threaded stems of the inserts, as seen in FIGS. 2 and 2*a*. Curing time in the mold is about five minutes, after which the mold parts are separated and the solidified core is removed, while keeping the rods in position. The core is then allowed to completely cure, for about 24 hours.

Figure 6:
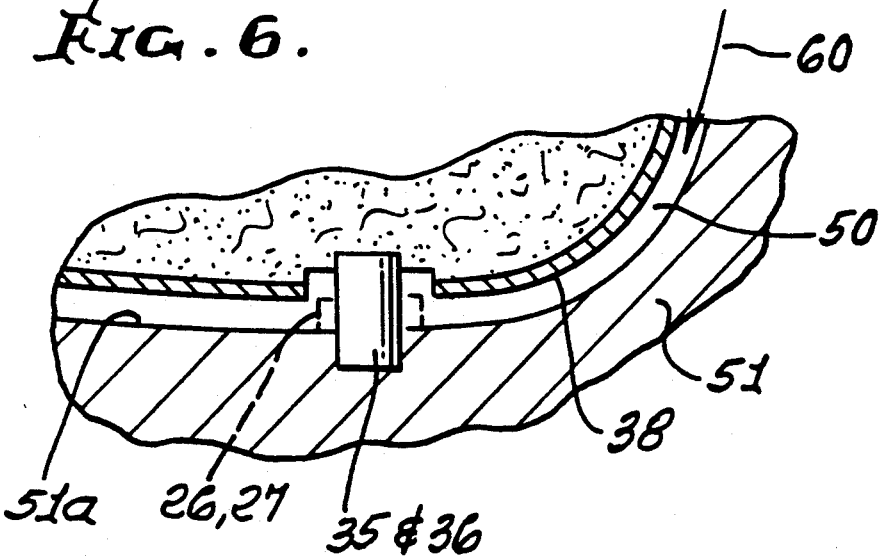
FIG. 6 is a section showing die casting.

The core is then coated with a coating, seen at 36 in FIG. 6, as by dipping into a coating solution, at room temperature. One usable solution is known as "STYROMOL 169", produced by Foseco Japan Ltd. The coated core is then baked in a first oven for 30 minutes at about 150° C.; and then baked in a second oven at 230° for one hour, curing the coating. Such cured coating provides a barrier against penetration of hot die cast metal into the solidified sand core.

STYROMOL 169 is an insulating and low permeability coating used for coating polystyrene patterns used in "EVAPORATIVE (LOST FOAM)" casting process.

STYROMOL 169 is the most widely used coating for thin section castings of 4 to 5 mm wall thickness. The low permeability controls metal velocity allowing controlled, regular filling of the pattern.

STYROMOL 169 is manufactured to strict quality standards to give. Its basic properties include the following:

Will not attack polystyrene

Wets the pattern

Good dipping or overpouring rheology

No syneresis

Dried layer is tough and adhering

Dried layer free from defects

The metal used for a one-body cast metal wood is aluminum alloy A380,383 or 384, density 2.740 g/c.c (0.098 lb/in$^3$), liquidus temperature 595° C., solidus temperature 540° C.

FIG. 6 shows injection at 60 of such metal into the head shell forming gap 50 between the coating 38 and the inner wall 51*a* of the die casting mold body 51. The injected metal flows about rods 35 and 36. After a metal cooling and hardening interval, the core with its applied coating is removed. The iron rods 35 and 36 are then removed, leaving openings in the shell bottom wall 14, and in the integral sand core, for reception of the inserts when they are connected into the bottom wall. For this purpose, the openings in the bottom wall may be threaded, as by use of a thread forming tool, to threadably receive the inserts. Counterbores 26 and 27 may also be formed in the bottom wall to receive the insert heads.

One-body, cast, metal wood heads can thus be formed with precision weight distribution. They are as strong as irons, and are tougher than known metal wood heads. Also they have a lower and adjustable center of mass, for best performance. Such one-body cast heads need no welding or screws to attach any parts, such as inserts. They are effective and economical products. The weighted ports are important for the following reasons:

1. The head center of gravity remains in the correct location.

2. Weighted ports provide an excellent "personalization" insert capability.

3. Weighted ports with selected inserts retain maximum flexibility for customized swing weight alteration anytime during the life of the club; i.e. different selected weight inserts can be attached tot he parts. Clubs without weighted ports are not easily adjustable and changeable.

SUMMARY

A one-body cast metal wood can be successfully manufactured with a special sand core which maintains its dimensions against high pressure and temperature n die casting until molten metal is solidified. When inside temperature of the core rises above the decomposition temperature of resin used in the core, the core itself breaks down into sandy fragments easily cleaned through prepared openings on the bottom of the one-body cast metal wood which is weight controlled and precisely designed. Furthermore, the openings receive weight port medallions or inserts providing an excellent personalization capability.

I claim:

1. In the method of making a golf club head comprising a shell having a ball striking face, a top wall, a bottom wall, a rear wall, and toe and heel walls, the steps that include a) forming a head core consisting of particles of sand or the like in a binder, b) and casting molten lightweight metal about said core to form the shell walls, c) forming multiple ports in said bottom wall by supporting rods to project into the core and by casting said metal about said rods, and removing the rods, d) removing at last part of the core via one of said ports, and then connecting metal inserts into said shell at said ports.

2. The method of claim 1 including preliminary forming said inserts to have weights selected for golf club balance and swing adjustment.

3. The method of claim 1 wherein said ports are formed at different positions in said bottom wall to accommodate reception of said weights selected for golf club balance and swing adjustment.

4. The method of claim 1 including cleaning out the core, via said ports, prior to said connecting of inserts into said shell.

5. The method of claim 1 including applying a surface coating to the core prior to said casting step, said coating characterized as decomposing at temperatures in excess of about 1,000° C.

6. The method of claim 1 wherein said binder includes a mixture of phenolic resin and isobutyro-nitrile acid, said resin curing at high temperature.

7. The method of claim 1 wherein said shell consists of aluminum alloy.

* * * * *